United States Patent [19]

Yano et al.

[11] Patent Number: 4,603,460

[45] Date of Patent: Aug. 5, 1986

[54] METHOD FOR MANUFACTURING A HEAT EXCHANGER

[75] Inventors: Nobuyuki Yano, Hirakata; Takashi Inami, Suita; Mitsuru Ieki, Tsuzuki; Masao Wakai, Kasugai, all of Japan

[73] Assignees: Matsushita Electric Industrial Co., Ltd.; Matsushita Seiko Co., Ltd., both of Osaka, Japan

[21] Appl. No.: 654,673

[22] Filed: Sep. 26, 1984

[30] Foreign Application Priority Data

Sep. 30, 1983 [JP] Japan ..... 58-183383

[51] Int. Cl.[4] ..... B21D 53/02; B23P 15/26; B31D 3/02; B32B 7/14

[52] U.S. Cl. ..... 29/157.3 V; 29/458; 29/527.2; 156/197; 156/291; 228/183

[58] Field of Search ..... 165/10; 156/197, 291; 29/726, 727, 157.3 R, 157.3 V, 157 R, 458, 527.2; 228/118, 181, 183, 193, 194, 208, 245, 248, 261

[56] References Cited

U.S. PATENT DOCUMENTS 2,957,679 10/1960 Campbell ..... 29/157.3 V X
2,999,306 9/1961 Baxter ..... 29/157.3 V
3,025,964 3/1962 Summers et al. ..... 156/197 X
3,112,559 12/1963 Pauls ..... 29/157.3 V
3,206,839 9/1965 Tranel et al. ..... 29/157.3 V
4,109,711 8/1978 Kleine et al. ..... 29/157.3 V X
4,133,709 1/1979 Carrico ..... 156/291 X
4,521,947 6/1985 Nonnenmann et al. ..... 29/157 R

FOREIGN PATENT DOCUMENTS 55544 5/1978 Japan ..... 29/157.3 R

*Primary Examiner*—Howard N. Goldberg
*Assistant Examiner*—Ronald S. Wallace
*Attorney, Agent, or Firm*—Wenderoth, Lind & Ponack

[57] ABSTRACT

A method of manufacturing a heat exchanger in which a laminate prepared by laminating many sheets one upon another so that the neighboring sheets may be formed with bonded portions and non-bonded portions, is expanded in such a direction that the respective sheets are spaced from each other so as to form flow channels or passages between the sheets at the non-bonded portions, and which employs the steps of printing patterns of bonded material onto the sheets, laminating the sheets, and subsequently expanding the laminate of the sheets to form the heat exchanger.

11 Claims, 11 Drawing Figures

METHOD FOR MANUFACTURING A HEAT EXCHANGER

BACKGROUND OF THE INVENTION

The present invention generally relates to an improvement of a method of manufacturing a heat exchanger which may be utilized for a heat exchanging ventilation arrangement or the like for reducing heat loss during ventilation and more particularly, to a method of manufacturing a heat exchanger in which a laminate prepared by piling many sheets one upon another so that the neighboring sheets may be formed with bonded portions and non-bonded portions, is expanded in such a direction that the respective sheets are spaced from each other so as to define flow channels or passages between the sheets at the non-bonded portions, and which employs the steps of printing patterns of bonded material onto the sheets, laminating the sheets, and subsequently expanding the laminate to form the heat exchanger.

Generally, heat exchangers employed for heat exchanging ventilation arrangements, etc. are broadly divided into heat exchangers of a rotary type and those of a stationary plate type. With respect to materials for elements of the heat exchangers as described above, there have generally been employed such materials as paper, metals, plastics, ceramics, etc.

Various constructions are presently employed for the elements. For example, in the case of a total heat exchanger intended to reduce heat loss during ventilation, for rotary type heat exchangers, there is mainly adopted such a construction that a corrugated board prepared by overlapping a flat sheet S1 over a corrugated sheet S2, is wound into a spiral shape in the form of a disc matrix as shown in FIG. 1 or a construction in which a metallic wire or moisture absorbing natural fibers formed into a net-like structure is employed as a heat exchanging medium (not particularly shown). On the other hand, with respect to a stationary plate type heat exchanger, there is generally employed a construction as shown in FIG. 2 in which corrugated boards each prepared by alternately overlapping partition sheets S3 and corrugated spacing sheets S4 each other, are piled up in turn one upon another so that a primary air flow fa and a secondary air flow fb may be alternately passed through the respective layers between the partition plates S3.

The conventional heat exchangers as described above, however, have such disadvantages that the pressure loss thereof is high, shaping at end faces thereof tends to be troublesome, and cost is generally high.

SUMMARY OF THE INVENTION

Accordingly, an essential object of the present invention is to provide a method of manufacturing a heat exchanger in which a laminate prepared by laminating many sheets one upon another so that the neighboring sheets may be formed with bonded portions and non-bonded portions, is expanded in such a direction that the respective sheets are spaced from each other so as to form flow channels or passages between the sheets at the non-bonded portions, and which employs the steps of printing patterns of bonded material onto the sheets, laminating the sheets, and subsequently expanding the laminate of the sheets to form the heat exchanger.

Another important object of the present invention is to provide a method of manufacturing a heat exchanger as described above which may be readily introduced into an automated manufacturing process, with a consequent reduction in cost of the heat exchanger.

In accomplishing these and other objects, according to one preferred embodiment of the present invention, there is provided a method of manufacturing a heat exchanger, which includes the steps of forming patterns of a bonding material on sheets, laminating the sheets thus formed with the patterns of the bonding material so as to be bonded into one laminate, expanding the laminate thus formed in a direction of lamination or in a circumferential direction for forming flow passages between non-bonded portions of the respective sheets, and fixing the laminate in the expanded state.

By the steps according to the present invention as described above, an improved method of manufacturing a heat exchanger has been advantageously presented.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

Figure 1:
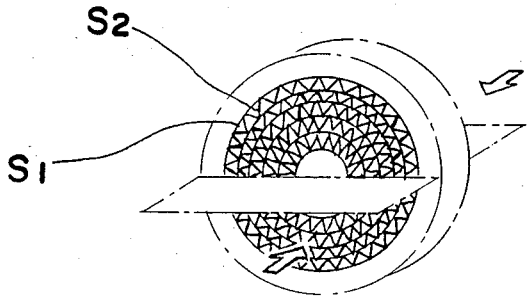
Fig. 1 PRIOR ART
FIG. 1 is a schematic perspective view showing one example of a rotor for a conventional rotary type total heat exchanger (already referred to)
Figure 2:
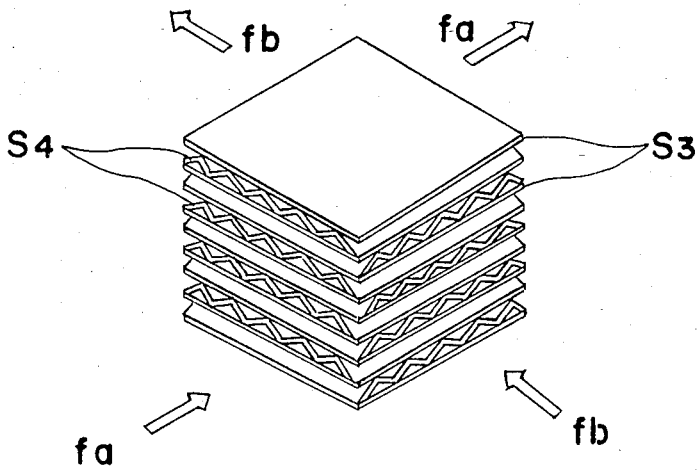
Fig. 2 PRIOR ART
FIG. 2 is a schematic perspective view showing one example of a conventional stationary plate type total heat exchanger (already referred to)

Before the description of the present invention proceeds, it is to be noted that like parts are designated by like reference numerals throughout the accompanying drawings.

Figure 3:
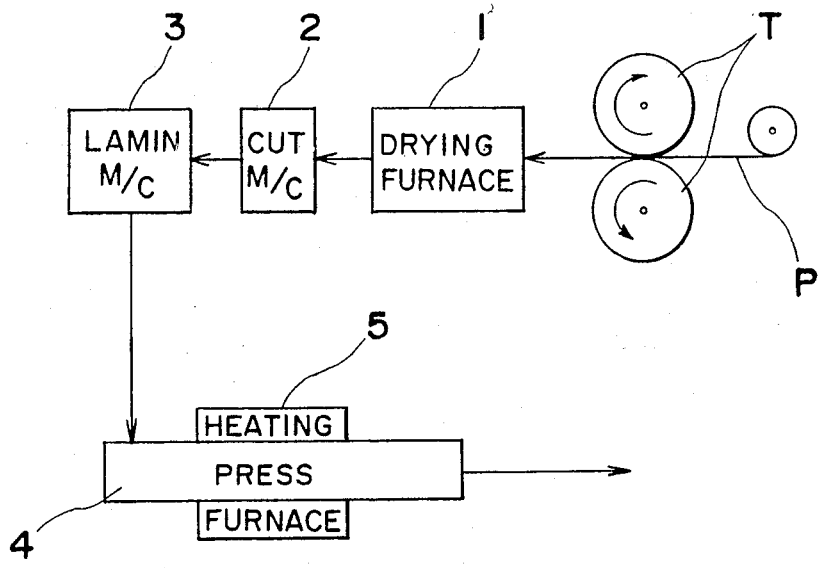
FIG. 3 is a flow-chart of a manufacturing process for a method of manufacturing a heat exchanger according to one preferred embodiment of the present invention.

Referring now to the drawings, there is shown in FIG. 3 a flow-chart showing an outline of manufacturing steps for a method of manufacturing a heat exchanger according to one preferred embodiment of the present invention, which generally includes the use of a pair of rotors T having necessary bonding patterns on their surfaces and rotatably provided for applying or printing a bonding material, for example, a polyester group bonding material in this embodiment, onto kraft paper P drawn out from a paper roll as the kraft paper P is passed through therebetween, a drying furnace 1 for once drying the bonding material thus applied onto the kraft paper P, a cutting machine 2 for cutting the kraft paper P into sheets after drying, a laminating machine 3 for piling the sheets one upon another to form a laminate, and a press unit 4 provided with a heating furnace 5 for heating the laminate thus prepared under pressure so as to bond the neighboring sheets to each other at the portions where the bonding material is applied.

Figure 4:
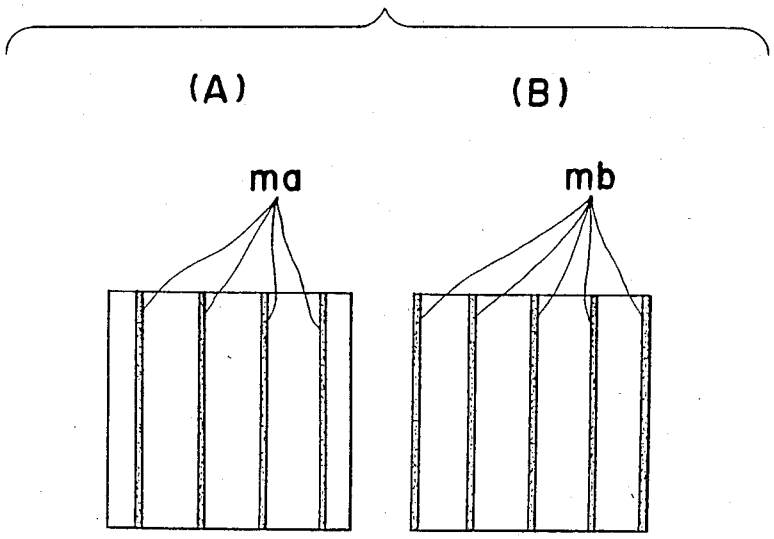
FIG. 4 shows diagrams illustrating patterns of a bonding material as printed onto kraft paper sheets.
Figure 5:
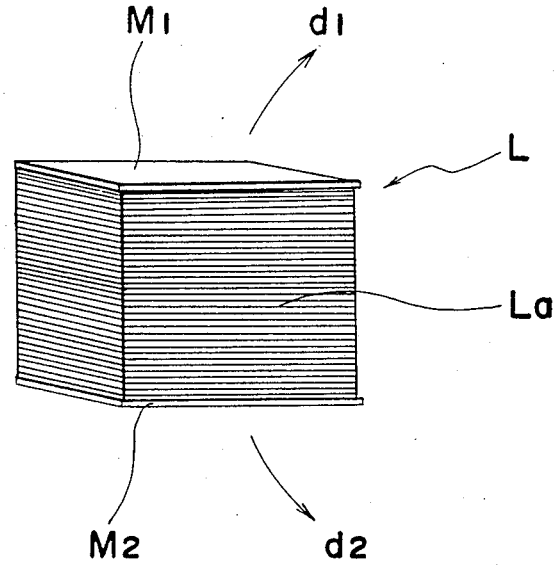
FIG. 5 is a perspective view of a laminate prepared by laminating sheets printed with necessary patterns of the bonding material alternately according to the respective patterns.

More specifically, referring to FIG. 4 showing one example of application patterns of the bonding material m as applied or printed onto the kraft paper P, a pattern A and a pattern B are alternately printed on rectangular areas of the kraft paper P as the rotors T effects one rotation. In FIG. 4, portions printed with the bonding material m are indicated by symbols ma and mb. The application patterns A and B are in the form of parallel lines whose positions deviate from each other between the patterns A and B in such a relation that, upon bonding of the sheets to each other, the bonding material lines in one pattern are located at intermediate portions of the bonding material lines in the other pattern. Although not particularly shown, it may be so modified that the parallel bonding material lines in the A and B patterns are arranged in directions at right angles with each other. The kraft paper P thus printed with the patterns of the bonding material is passed through the drying furnace 1 for drying of the bonding material. After the drying, the kraft paper P is cut off by the cutting machine 2, into sheets having the patterns A and B, which are successively piled one upon another alternately by the laminating machine 3 so as to prepare a laminate L as shown in FIG. 5. Subsequently, aluminum plates M1 and M2 are applied onto upper and lower portions of the laminate L by a bonding material. The laminate L thus prepared is placed on the press unit 4 so as to be heated in the heating furnace 5 at 150° C. for about 15 minutes, and thereafter, spontaneously cooled under pressure for bonding the neighboring sheets to each other at the portions printed with the bonding material. In the above case, the process may be so modified that the laminate L of the sheets held between the aluminum plates M1 and M2 is placed in the heating furnace without the pressing for a uniform heating, and subsequently, subjected to the press unit 4 for effecting the bonding.

On the other hand, in the case where a material capable of being bonded at normal temperatures such as a vinyl acetate group material or the like is employed for the bonding material used at the rotors T, it may be so arranged that respective patterns of the bonding material are printed on sheets preliminarily cut before application to the rotors T, and the sheets thus prepared are alternately laminated so as to be dried while being compressed by the press unit 4, and in this case, the heating furnace 5 may be dispensed with.

Figure 6:
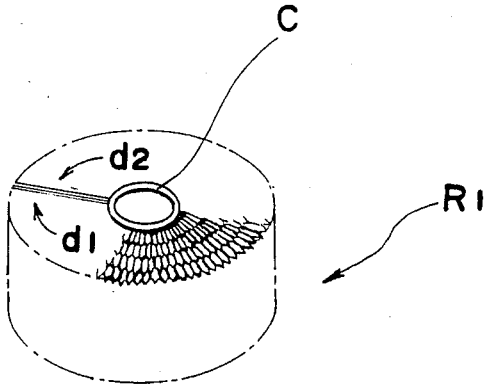
FIG. 6 is a perspective view showing a rotor for a regenerative rotary type heat exchanger manufactured by the method of the present invention, FIG. 7 are diagrams showing another embodiment of patterns of the applied bonding material.

The laminate L in which the neighboring sheets are bonded to each other as illustrated in FIG. 5 is expanded by turning the aluminum plates M1 and M2 in directions indicated by arrows d1 and d2 about one side La of the laminate L as a center of a circle provided with a hollow cylinder C, for example, of plastic material, and the aluminum plates M1 and M2 are combined with each other for fixing, and thus, a regenerative rotary type rotor R1 as shown in FIG. 6 is obtained.

It should be noted here that in the foregoing embodiment, although the kraft paper is employed as the material for the elements, such material is not limited to the kraft paper alone, but may be replaced, for example, by a plastic sheet, or a metallic foil such as an aluminum foil, etc. Similarly, the configuration of the laminate L described as the rectangular box-like shape in the above embodiment may be modified, for example, to a cylindrical shape.

Figure 7:
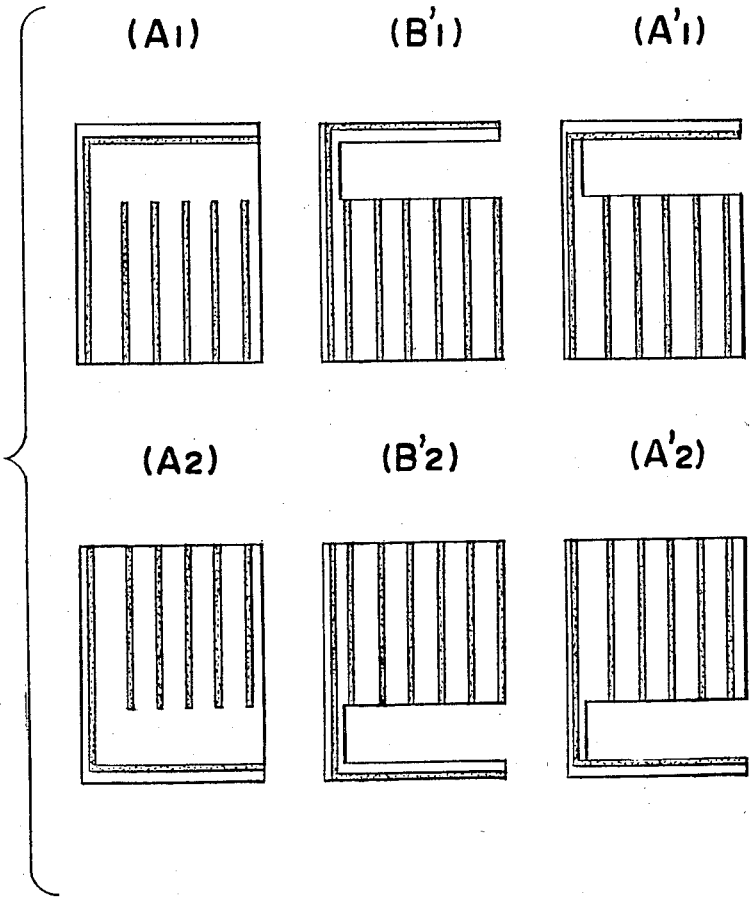

Referring further to FIG. 7, there are shown sheets A1, B'1, A'1, A2, B'2 and A'2 formed with different patterns of the bonding material according to another embodiment of the present invention. In these sheets, each of the sheets B'1, A'1, B'2 and A'2 has one part cut out, but the sheets A'1 and A1, and A'2 and A2 respectively have the same patterns of the bonding material.

More specifically, in the above embodiment, there are provided the sheet A1 formed with an L-shaped bonding material pattern directed along two neighboring sides (edges) of the sheet, and a plurality of rows of bonding material patterns provided in the form of lines parallel to one side of said L-shaped bonding material pattern, with a portion without any bonding material pattern being provided between the other side of said L-shaped bonding material pattern and corresponding ends of the plurality of rows of bonding material patterns, sheets B'1 and A'1 formed by cutting out the portion without any bonding material pattern in the sheet A1, and sheets A2, B'2 and A'2 having patterns of the bonding material and cut-out portion in a positional relation in which said sheets A1, B'1 and A'1 are respectively turned over for rotation through 180°.

Figure 8:
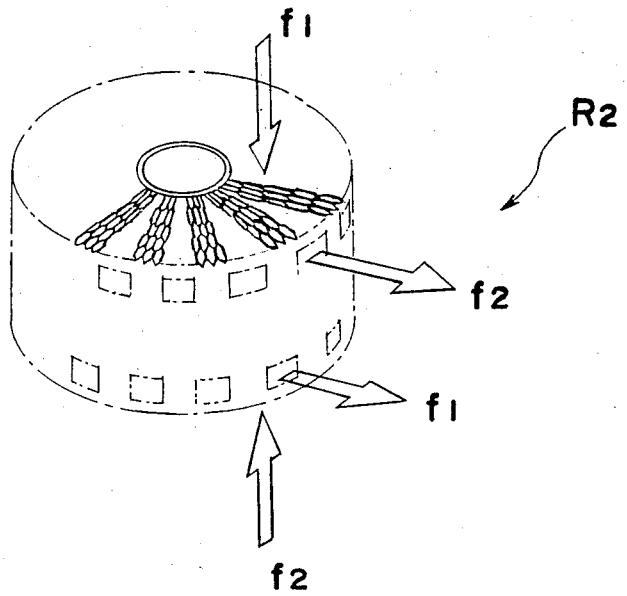
FIG. 8 is a schematic perspective view of a cylindrical counterflow heat exchanger manufactured by the sheets applied with the bonding material patterns of FIG. 7.

In FIG. 8, there is shown a schematic perspective view of a heat exchanger R2 prepared by alternately laminating the sheets, for example, in the order or A1, B'1, A'1, B'1, A2, B'2, A'2, B'2, A1, . . . and so forth to form a laminate (not shown here), subjecting the laminate to bonding by heat under pressure, and expanding the laminate thus processed, into a cylindrical shape in the similar manner as described previously. This heat exchanger R2 represents one example of a cylindrical counterflow heat exchanger in which three spacing plates (not shown) are employed, with directions of air flows being represented by arrows f1 and f2. In the above example, when the A1 pattern (or A'1 pattern) is printed on the reverse side of the sheet B'1 and the A2 pattern (or A'2 pattern) is printed on the reverse side of the sheet B'2, printing of the bonding material onto the sheets A1, A'1, A2, and A'2 is not required. Similarly, in the case where the patterns B'2, B'1, B'1 and B'2 are respectively printed on the reverse sides of the heating sheets A1, A'1, A2 and A'2 , printing of the bonding material onto the sheets B'1 and B'2 becomes unnecessary.

Figure 9:
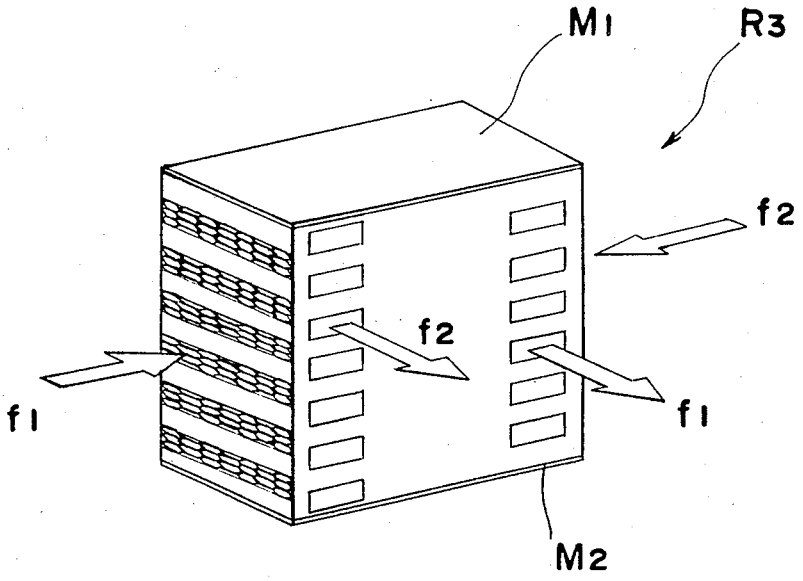
FIG. 9 is a schematic perspective view of a stationary type counterflow heat exchanger manufactured in a manner similar to the method by which the heat exchanger shown in FIG. 8 is manufactured.

Subsequently, instead of expanding the laminate of the bonded sheets into the cylindrical shape as in the above embodiment, if the laminate of the bonded sheets is expanded in the direction in which the aluminum plates M1 and M2 are spaced from each other, with said plate M1 being held in a parallel relation with the plate M2, a stationary type counterflow heat exchanger R3 in the form of a rectangular parallelopiped as shown in FIG. 9 is obtained, in which arrows f1 and f2 respectively denote directions of air flows.

Figure 10:
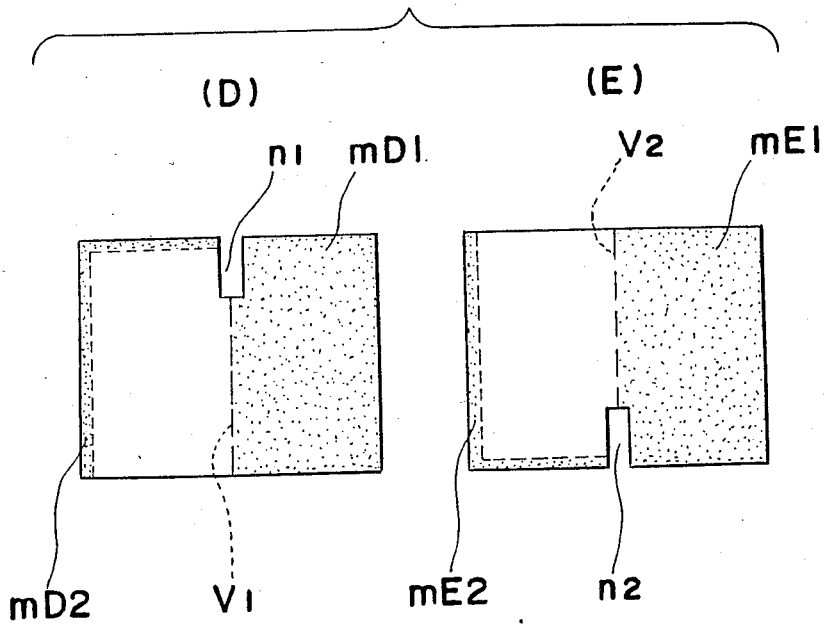
FIG. 10 shows diagrams illustrating still another embodiment of the patterns of the applied bonding material.

In FIG. 10, there are shown sheets D and E including the step of folding the sheets and related to still another embodiment of the present invention. In the above case, the sheets D and E are respectively printed with different patterns on the front and reverse surfaces thereof. More specifically, there are formed the pattern for the sheet D in which the bonding pattern mD1 is entirely formed on one half surface of the sheet, while the L-shaped bonding pattern mD2 is printed on the reverse side on the other half surface along two edges not corresponding to the bonding pattern mD1, and the pattern for the sheet E wherein the patterns are formed in the relation in which the sheet D is turned over. Each of the sheets D and E has a folding line V1 or V2 for the folding step to be effected before the lamination, and a portion n1 or n2 to be cut or notched at an intermediate portion of the sheet. In FIG. 10, the portions where the bonding materials are applied in the L-shape at the reverse surfaces of the sheets, are shown by the symbols mD2 and mE2, while the portions where the bonding materials are applied at the front surfaces are denoted by the symbols mD1 and mE1.

It is to be noted here that, in the above embodiment, the partial cutting of the sheets and cutting off of the sheets D and E may be effected after application and drying of the bonding material or before application thereof.

Figure 11:
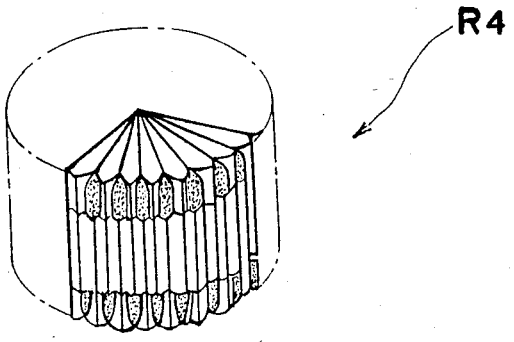
FIG. 11 is a schematic perspective view of a cylindrical counterflow heat exchanger manufactured by the sheets applied with the bonding material patterns of FIG. 10.

The sheets D and E each folded along the folding lines V1 and V2 so that the reverse surfaces thereof are directed inwardly, are alternately laminated in a large number and bonded by heat under pressure to obtain the laminate (not shown here), which is subsequently expanded into the cylindrical shape to obtain a cylindrical counterflow heat exchanger R4 as shown in FIG. 11.

As is clear from the foregoing description, according to the method of manufacturing the heat exchanger of the present invention, owing to the process including the steps of printing the bonding material patterns onto the sheets, laminating the sheets, and expanding the laminate of the sheets, automation of the manufacturing process is still more facilitated, with a consequent reduction in cost of the heat exchanger. Moreover, by altering the printed patterns of the bonding material, not only may elements having different flow passages be produced, but it becomes possible to produce heat exchangers of various types in an efficient manner.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A method of manufacturing a heat exchanger, comprising the steps of:

forming patterns of a bonding material on sheets;

after said step of forming patterns, laminating the sheets so that the bonding material on the sheets bonds the faces of successive sheets together to form a laminate;

expanding the laminate in a circular direction generally perpendicular to the faces of the sheets into an expanded state in a cylindrical configuration, so as to form flow passages between bonded portions in non-bonded portions of successive sheets; and after said step of expanding the laminate, fixing the laminate in the expanded state;

said step of forming patterns including the step of forming patterns of the bonding material such that flow passages on opposite sides of each sheet after said step of expanding the laminate are in heat exchanging relationship with each other, and each of the flow passages formed in said step of expanding communicate with the exterior of the laminate at opposite ends thereof.

2. A method as claimed in claim 1, wherein said step of forming patterns comprises the step of forming the patterns of bonding material along parallel lines, the parallel lines on alternate sheets deviating from the lines on the sheets between the alternate sheets in a direction in the planes of the respective sheets perpendicular to the direction of the lines.

3. A method of manufacturing a heat exchanger, comprising the steps of:

forming patterns of a bonding material on rectangular sheets, the sheets having opposite parallel first and second side edges, each having first and second ends, and opposite parallel third and fourth side edges, the third and fourth edges extending perpendicularly to the first and second edges respectively between the first ends of the first and second edges and between the second ends of the first and second edges, the sheets including first, second, third and fourth sets of sheets, the patterns of bonding material on the sheets in the first set including a first L-shaped pattern extending along the first and third edges and a pattern formed of parallel lines extending parallel to the first edge from the fourth edge toward the third edge, terminating at first terminal ends short of the portion of the first L-shaped pattern along the third edge, and being successively spaced in a direction perpendicular to the first edge between the first and second edges so as to define a first bonding material-free area of the sheet bounded by the first terminal ends, the first L-shaped portion and the second edge, free of bonding material, the patterns of bonding material on the sheets in the second set being substantially the same as those on the sheets of the first set and the sheets of the second set further having a cutout portion in the first bonding material-free area opening into the second edge, the patterns of bonding material on the sheets in the third set including a second L-shaped pattern extending along a same one of the first and second edges and the fourth edge and a pattern formed of parallel lines extending parallel to the first edge from the third edge toward the fourth edge, terminating at second terminal ends short of the portion of the second L-shaped pattern along the fourth edge, and being successively spaced in a direction perpendicular to the first edge between the first and second edges so as to define a second bonding material-free area of the sheet bounded by the second terminal ends, the second L-shaped pattern and the other one of the first and second edges, free of bonding material, the patterns of bonding material on the sheets in the fourth set being substantially the same as those on the sheets of the third set and the sheets of the fourth set further having a second cutout portion in the second bonding material-free area opening into the other one of the first and second edges;

repeatedly laminating individual sheets from the first, second, third and fourth sets over one another in the named order with the first, second, third and fourth edges of each sheet respectively generally aligned in the direction perpendicular to the faces of the sheets with the first, second, third and fourth edge of the all of the other sheets in the the first, second, third and fourth sets and such that the bonding material on the sheets bonds the faces of successive sheets together to form a laminate;

after said steps of forming patterns and repeatedly laminating, expanding the laminate in a direction generally perpendicular to the faces of the sheets into an expanded state so as to form flow passages between bonded portion in non-bonded portions of successive sheets; and after said step of expanding the laminate, fixing the laminate in the expanded state;

said step of forming patterns including the step of forming patterns of the bonding material such that flow passages on reverse sides of each sheet after said step of expanding the laminate are in heat exchanging relationship with each other and each of the flow passages formed in said steps of expanding between sheets of the first and second sets communicate with the exterior of the laminate at opposite ends thereof at the second edge through the first cutout portion and at the fourth edge and each of the flow passages formed in said step of expanding between sheets of the third and fourth sets communicate with the exterior of the laminate at opposite ends thereof at the other one of the first and second edges and at the third edge.

4. A method as in claim 3, wherein said same one of the first and second edges is the first edge and said other one of the first and second edges is the second edge.

5. A method as in claim 4, wherein said step of expanding comprises the step of expanding the laminate in a circular direction into an expanded state in a cylindrical configuration.

6. A method of manufacturing a heat exchanger, comprising the steps of:

forming patterns of a bonding material on rectangular sheets having first and second reverse side faces, the sheets having opposite parallel first and second side edges, each having first and second ends, and opposite parallel third and fourth side edges, the third and fourth edges extending perpendicularly to the first and second edges respectively between the first ends of the first and second edges and between the second ends of the first and second edges, the first, second, third and fourth side edges bounding the first and second faces, the sheets including first and second sets of sheets, the patterns of bonding material on the sheets in the first set including a first L-shaped pattern extending on the first side face along the first edge and no more than half of the third edge, the portion of the first L-shaped pattern along the third edge terminating at a first cutout portion formed at and opening into a mid-point of the third edge, and a solid pattern formed on the second side face over half of the sheet bounded by the second edge, respective immediately adjacent halves of the third and fourth edges, and a fold line extending parallel to the first and second edges between the respective mid-points of the third and fourth edges, the patterns of bonding material on the sheets in the second set including a second L-shaped pattern on the first side face extending along the first edge and no more than half of the fourth edge, the portion of the second L-shaped pattern along the fourth edge terminating at a second cutout portion formed at and opening into a mid-point of the fourth edge, and a solid pattern formed on the second side face over half of the sheet bounded by the second edge, respective immediately adjacent halves of the third and fourth edges and a fold line extending parallel to the first and second edges between the respective mid-points of the third and fourth edges;

folding each of the sheets in said first and second sets along the fold lines such that respective halves of the first side face oppose each other;

after said step of folding, affixing the first L-shaped patterns of the sheets of the first set to opposing portions of the respective first side faces so as to close the sheets of the first set along the respective first, second and third edges except at said first cutout portion, affixing the second L-shaped patterns of the sheets of the second set to opposing portions of the respective first side faces so as to close the sheets of the second set along the respective first, second and fourth edges except at said second cutout portion, and alternately laminating individual sheets from the first and second sets over one another with the first, second, third and fourth edges and fold line of each sheet respectively generally aligned in the direction perpendicular to the faces of the sheets and such that the bonding material on the second faces of the sheets of the first and second sets respectively bond with opposing portions of the second side faces of successive sheets of the second and first sets bounded by the respective fold lines thereof, the first edges thereof and the portions of the third and fourth edges between the fold lines and the first edges thereof, to form a laminate;

expanding the laminate in a circular direction perpendicular to the faces of the sheets into an expanded state in a cylindrical configuration so as to form flow passages between opposing non-bonded portions of each sheet; and after said step of expanding the laminate, fixing the laminate in the expanded state;

said step of forming patterns including the step of forming patterns of the bonding material such that flow passages on reverse sides of each sheet after said step of expanding the laminate are in heat exchanging relationship with each other, and each of the flow passages formed between opposing non-bonding portions of the sheets of the first set in said step of expanding communicates with the exterior of the laminate at opposite ends thereof at the first cutout portion and at the fourth edge, and each of the flow passages formed between opposing non-bonded portions of the sheets of the second set in said step of expanding communicates with the exterior of the laminate at opposite ends thereof at the second cutout portion and at the third edge.

7. A method of manufacturing a heat exchanger, comprising the steps of:

forming patterns of a bonding material on sheets, the sheets having opposite first and second side edges, each having first and second ends, and opposite third and fourth side edges, the third and fourth edges extending transversely to the first and second edges respectively between the first ends of the first and second edges and between the second ends of the first and second edges, the sheets including first and second sets of sheets, the patterns of bonding material on the sheets in the first set including a first L-shaped pattern extending along the first and third edges and a pattern formed of lines successively spaced apart in a direction extending from the first edge toward the second edge, extending from the fourth edge toward the third edge, terminating at first terminal ends short of the portion of the first L-shaped pattern along the third edge, so as to define a first bonding material-free area of the sheet bounded by the first terminal ends, the first L-shaped portion and the second edge, free of bonding material, the patterns of bonding material on the sheets in the second set including a second L-shaped pattern extending along a same one of the first and second edges and the fourth edge and a pattern formed of lines successively spaced apart in a direction extending from the first edge toward the second edge, extending from the third edge toward the fourth edge, terminating at second terminal ends short of the portion of the second L-shaped pattern along the fourth edge, so as to define a second bonding material-free area of the sheet bounded by the second terminal ends, the second L-shaped pattern and the other one of the first and second edges, free of bonding material;

alternately laminating individual sheets from the first and second sets over one another with the first, second, third and fourth edges of each sheet respectively generally aligned in the direction perpendicular to the faces of the sheets with the first, second, third and fourth edge of all of the other sheets in the first and second sets and such that the bonding material on the sheets bonds the faces of successive sheets together to form a laminate;

after said steps of forming patterns and alternately laminating, expanding the laminate in a direction generally perpendicular to the faces of the sheets into an expanded state so as to form flow passages between bonded portions in non-bonded portions of successive sheets; and after said step of expanding the laminate, fixing the laminate in the expanded state;

said step of forming patterns including the step of forming patterns of the bonding material such that flow passages on reverse sides of each sheet after said step of expanding the laminate are in heat exchanging relationship with each other and such that the flow passages between the bonded portions bonded with the patterns formed on the first set of sheets during said step of forming patterns communicate with the exterior of the laminate at opposite ends thereof at the second edge between the portion of the first L-shaped pattern along the third edge and the first terminal ends and at the fourth edge and the flow passages between the bonded portions bonded with the patterns formed on the second set of sheets during said step of forming patterns communicate with the exterior of the laminate at opposite ends thereof at the other one of the first and second edges between the portion of the second L-shaped pattern along the fourth edge and the second terminal ends and at the third edge.

8. A method as in claim 7, wherein the step of forming patterns on sheets comprises the step of forming the patterns on rectangular sheets having the first and second edges parallel to each other and the third and fourth edges parallel to each other and extending perpendicularly to the first and second edges.

9. A method as in claim 8, wherein said step of forming patterns includes the steps of forming the patterns formed in lines on the first and second sheets only in lines parallel to said first edge.

10. A method as in claim 7, wherein said same one of the first and second edges is the first edge and said other one of the first and second edges is the second edge.

11. A method as in claim 10, wherein said step of expanding comprises the step of expanding the laminate in a circular direction into an expanded state in a cylindrical configuration.

* * * * *